US009100738B2

(12) United States Patent
Voishvillo et al.

(10) Patent No.: US 9,100,738 B2
(45) Date of Patent: Aug. 4, 2015

(54) ELECTRODYNAMIC LOUDSPEAKER WITH CONDUCTING ELEMENTS

(71) Applicant: Harman International Industries, Inc., Stamford, CT (US)

(72) Inventors: Alexander Voishvillo, Simi Valley, CA (US); Felix Kochendoerfer, Sherman Oaks, CA (US)

(73) Assignee: Harman International Industries, Inc., Stanford, CT (US)

( * ) Notice: Subject to any disclaimer, the term of this patent is extended or adjusted under 35 U.S.C. 154(b) by 0 days.

(21) Appl. No.: 14/449,644

(22) Filed: Aug. 1, 2014

(65) Prior Publication Data

US 2015/0078610 A1 Mar. 19, 2015

Related U.S. Application Data

(60) Provisional application No. 61/861,145, filed on Aug. 1, 2013.

(51) Int. Cl.
*H04R 9/06* (2006.01)
*H04R 9/02* (2006.01)

(52) U.S. Cl.
CPC ..... *H04R 9/02* (2013.01); *H04R 9/025* (2013.01); *H04R 2209/022* (2013.01)

(58) Field of Classification Search
CPC ..... H04R 9/02; H04R 9/025; H04R 2209/022
USPC ..... 381/396, 412, 414, 420
See application file for complete search history.

(56) References Cited

U.S. PATENT DOCUMENTS

| | | | | |
|---|---|---|---|---|
| 3,830,986 | A | 8/1974 | Yamamuro | |
| 5,815,587 | A * | 9/1998 | Goller | 381/412 |
| 6,768,806 | B1 * | 7/2004 | Button et al. | 381/401 |
| 7,283,642 | B2 | 10/2007 | Milot et al. | |
| 7,929,726 | B1 * | 4/2011 | Jones | 381/431 |
| 2006/0078151 | A1 * | 4/2006 | Kemmerer et al. | 381/397 |

FOREIGN PATENT DOCUMENTS

| | | | |
|---|---|---|---|
| WO | 94/27413 | A1 | 11/1994 |
| WO | 99/48329 | A1 | 9/1999 |

OTHER PUBLICATIONS

Harry F. Olson, Modern Sound Reproduction, Van Nostrand Reinhold Company, 1972, pp. 1-4.

(Continued)

*Primary Examiner* — Tuan D Nguyen
(74) *Attorney, Agent, or Firm* — Brooks Kushman P.C.

(57) ABSTRACT

A loudspeaker includes a motor assembly including a magnet having a first face and a second face, a back plate abutting the magnet first face, a pole piece centrally disposed with respect to the back plate and extending beyond the magnet second face, and a top plate concentrically disposed with respect to the pole piece and extending beyond the magnet second face. A non-magnetic conducting frame is attached to the top plate, a non-magnetic conducting cap is disposed within the motor assembly and encircling the pole piece, a first non-magnetic conducting ring is disposed within the motor assembly and encircling the pole piece, and at least one second non-magnetic conducting ring is disposed within the motor assembly and abutting the back plate.

20 Claims, 10 Drawing Sheets

(56) References Cited

OTHER PUBLICATIONS

Victor Mazin et al., Non-uniform Voice Coil Winding for Electrodynamic Loudspeaker, Audio Engineering Society, Convention Paper 6152, May 8-11, 2004, pp. 1-9.
Mark A. Gander, Moving-Coil Loudspeaker Topology as an Indicator of Linear Excursion Capability,J. Audio Eng. Soc., vol. 29, No. 1/2, Jan./Feb. 1981, pp. 1-17.
Marco Carlisi et al., An alternative approach to minimize Inductance and related Distortions in Loudspeakers, Audio Engineering Society, Convention Paper 6421, May 28-31, 2005, pp. 1-19.

Extended European Search Report for corresponding application EP 14179579.9, dated Feb. 12, 2015, 7 pages.

* cited by examiner

ELECTRODYNAMIC LOUDSPEAKER WITH CONDUCTING ELEMENTS

CROSS-REFERENCE TO RELATED APPLICATIONS

This application claims the benefit of U.S. provisional application Ser. No. 61/861,145 filed Aug. 1, 2013, the disclosure of which is hereby incorporated in its entirety by reference herein.

TECHNICAL FIELD

Embodiments relate to electrodynamic loudspeakers having conducting elements.

BACKGROUND

An electrodynamic motor includes a magnet assembly that generates a constant magnetic field in a magnetic air gap and the voice coil immersed in the gap. An alternating current corresponding to electrical signals conveying audio signals interacts with the constant magnetic field. This interaction results in the Laplace force F, expressed as a product of the magnetic flux density B, the overall length of the voice coil's turns linked to the magnetic flux l, and the value of the electrical current running through the voice coil i, F=Bli. Due to the Laplace force acting on the voice coil wire positioned in the constant magnetic field, the alternating current actuates the voice coil to move back and forth in the magnetic air gap and, correspondingly, move the diaphragm to which the coil (or coil former) is attached. Accordingly, the reciprocating voice coil actuates the diaphragm to likewise reciprocate and, consequently, produce acoustic signals that propagate as sound waves through air.

Typically, the product Bl (called the force factor) is a function of the voice coil position in the voice coil gap: Bl(x), as shown in FIG. 1. The typical dependence of the Bl-product on displacement is essentially that of a soft limiter and remains almost constant at low levels of signal, thus producing minimum nonlinear distortion. In addition, the voice coil inductance is a function of the voice coil's position and it also depends on the instantaneous value of the current: $L_{vc}(x, i)$, as shown in FIGS. 2 and 3, respectively, even at very small levels of signal. These latter two nonlinear parameters are major sources of nonlinear distortion in an electrodynamic loudspeaker. When the voice coil is in the inward position, it is surrounded by steel parts of the motor and its inductance is higher compared to the outward protruding position when part of the voice coil is surrounded by air. When the high-level current runs through the voice coil, it may saturate parts of the steel adjacent to the voice coil. Saturated steel has lower magnetic permeability and therefore the voice coil inductance decreases.

In general, operation of an electrodynamic loudspeaker is described by two nonlinear ordinary differential equations (W. Klippel, "Measurement of Large Signal Parameters of Electrodynamic Transducer", presented at the 107st Convention of the Audio Engineering Society, preprint 5008, September 1999).

One of the equations describes the balance of forces:

$$Bl(x)i = m_{ms}\frac{d^2x}{dt^2} + R_{ms}\frac{dx}{dt} - \frac{1}{2}\frac{dL_{vc}(x, i)}{dx}i^2 + K_{ms}(x)x \quad (1)$$

where $m_{ms}$ is the moving mass, $R_{ms}$ is the mechanical losses, and $K_{ms}(x)$ is the suspension's mechanical stiffness.

The second equation describes the balance of voltages for the case when the loudspeaker is driven by an amplifier with negligibly small output impedance, where $R_{vc}$ is the simple resistance and $L_{vc}$ is the ideal inductance that does not depend on frequency:

$$U = R_{vc}i + Bl(x)\frac{dx}{dt} + \frac{L_{vc}(x, i)}{dx}\frac{dx}{dt}i + \frac{di}{dt}L_{vc}(x, i) \quad (2)$$

As it follows from the equations (1) and (2), the nonlinearities coming from the terms Bl(x) and $L_{vc}(x,i)$ are dominant. It is important to minimize dependence of these parameters on displacement and current.

In reality, the impedance of a loudspeaker voice coil does not only contain a simple resistance $R_{vc}$ and an ideal inductance $L_{vc}$. Since the voice coil is surrounded by ferromagnetic and conductive materials, the voice coil impedance also incorporates magnetic losses and eddy currents. Thus, the ideal inductive element $Z_L=j\omega L_{vc}$ should be replaced by the complex and frequency dependent element:

$$Z_L=R_{eff}(f)+j\omega L_{eff}(f) \quad (3)$$

where $L_{eff}$ is the frequency dependent inductance and $R_{eff}$ describes the electrical and magnetic losses due to the material surrounding the voice coil.

There are various existing methods that attempt to linearize the Bl-product and the voice coil inductance. The most popular methods are using either an overhung voice coil or an underhung voice coil (Gander M, *J. Audio Eng. Soc.*, vol. 29, pp. 10-26, 1981, January/February). With an overhung voice coil, the electrodynamic linkage occurs only in a small part of the voice coil. With an underhung voice coil, the linkage is provided in a small part of the top plate and pole piece. Another prior method includes the use of an uneven winding of the voice coil (Olson H, Van Nostrand Reinhold, 1972, pp. 23-25; Mazin V and Sang Lee Y, 116th AES Convention, preprint 6152, 2004, Berlin). This method requires more turns at the peripheries of the voice coil, and also requires a wider gap to accommodate extra layers of peripheral turns and more complexity in fabricating the voice coil. Another prior approach is proposed in U.S. Pat. No. 7,283,642, wherein the underhung voice coil and the top plate and pole piece have cavities. The cavities are positioned against the central position of the voice coil. However, as the voice coil moves out of the gap, the Bl product remains flat because the loss of the magnetic linkage is compensated by the increased induction B.

One method to minimize variation of the alternating magnetic flux produced by the voice coil, and correspondingly, to minimize the voice coil inductance value at a zero position, as well as to minimize the dependence of the voice coil inductance on the coil's position and current involves implementing a selected conducting element. For example, conductive plating may be provided on a pole piece, a conductive cap may be provided over the pole piece, and a conductive ring may be used (Gander M, *J. Audio Eng. Soc.*, vol. 29, pp. 10-26, 1981, January/February). The conductive elements act as a single-turn secondary winding of a transformer. The alternating current generated in the "secondary" turn produces an alternating current. This current generates an alternating magnetic flux opposite in sign to the flux generated by the voice coil and therefore decreases it. Such methods may be directed to minimizing the voice coil dependence on current and may decrease the absolute value of the inductance.

However, they may not improve linearity of the voice coil inductance as a function of displacement.

An alternative approach to minimize variation of the voice coil alternating flux is using active compensation (Carlisi M et al., 118th AES Convention, preprint 6421, 2005, Barcelona). In this method, instead of using a single-turn conductive element, a multi-turn stationary coil is used. It makes possible various ways of driving the secondary coil, such as driving it with an additional amplifier, driving it in parallel with the voice coil from a single amplifier, driving it through the filter that shapes the driving level with the frequency, and simply shorting the stationary coil.

The nonlinearity that distorts a signal at its low levels is especially detrimental to the audible sound quality. Therefore, it is important to keep the "linear" value of the voice coil inductance as well as its variation on displacement and current low to minimize the flux modulation and to decrease the high-frequency attenuation cause by the impedance's inductive component.

SUMMARY

In one embodiment, a loudspeaker includes a motor assembly including a magnet having a first face and a second face, a back plate abutting the magnet first face, a pole piece centrally disposed with respect to the back plate and extending beyond the magnet second face, and a top plate concentrically disposed with respect to the pole piece and extending beyond the magnet second face. A non-magnetic conducting frame is attached to the top plate, a non-magnetic conducting cap is disposed within the motor assembly and encircling the pole piece, a first non-magnetic conducting ring is disposed within the motor assembly and encircling the pole piece, and at least one second non-magnetic conducting ring is disposed within the motor assembly and abutting the back plate.

In another embodiment, a loudspeaker includes a motor assembly including a magnet having a first face and a second face, a back plate abutting the magnet first face, a pole piece abutting the magnet second face, and a top plate concentrically disposed with respect to the pole piece and abutting the back plate. A frame is attached to the top plate and at least partially formed of aluminum, a copper cap is disposed within the motor assembly and encircling the pole piece, a copper ring is disposed within the motor assembly and encircling the pole piece, and at least one aluminum ring is disposed within the motor assembly and abutting the back plate.

In another embodiment, a loudspeaker includes a motor assembly including a back plate, a pole piece centrally mounted on the back plate, a top plate concentrically disposed about the pole piece, and a magnet concentrically disposed about the pole piece between the back plate and the top plate. A frame is attached to the top plate and at least partially formed from aluminum, a copper cap is disposed within the motor assembly and encircling the pole piece, a copper ring is disposed within the motor assembly and encircling the pole piece, and at least one aluminum ring is disposed within the motor assembly and abutting the back plate.

DETAILED DESCRIPTION

As required, detailed embodiments of the present invention are disclosed herein; however, it is to be understood that the disclosed embodiments are merely exemplary of the invention that may be embodied in various and alternative forms.

The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Various embodiments as disclosed herein include a plurality of conductive elements in the voice coil gap and around its vicinity to linearize the force factor Bl as a function of the voice coil position Bl(x), and the voice coil inductance $L_{vc}$ as a function of the coil's position $L_{vc}(x)$ and the function of the voice coil's current $L_{vc}(i)$. In addition to being a very linear function of the coil's position and the current, the absolute value of the voice coil's inductance $L_{vc}$ is very low.

Figure 1:
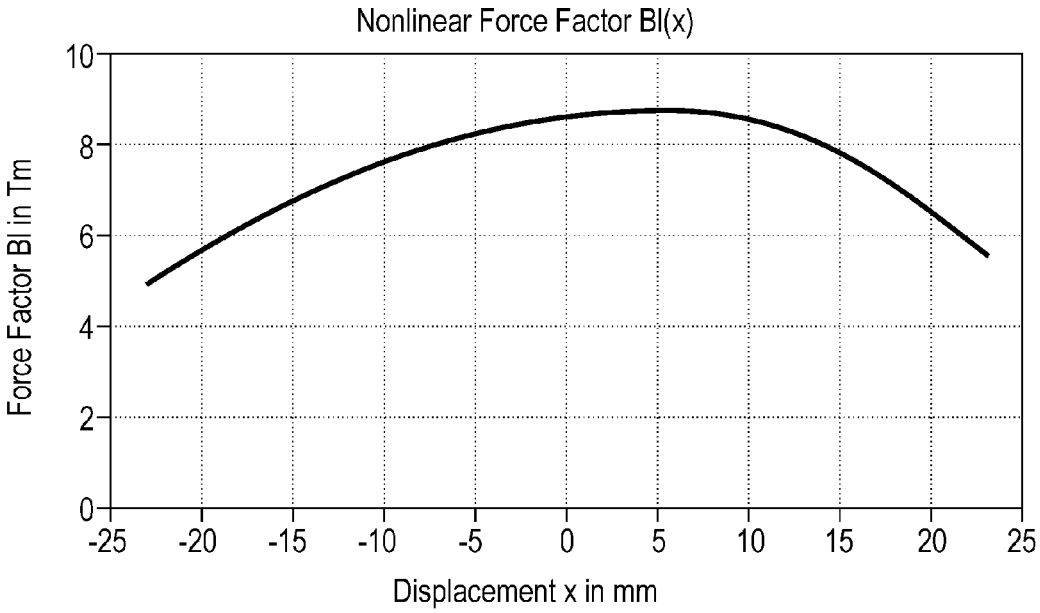
FIG. 1 (PRIOR ART)
FIG. 1 is a graph of the dependence of the force factor Bl-product on the position of the voice coil.
Figure 2:
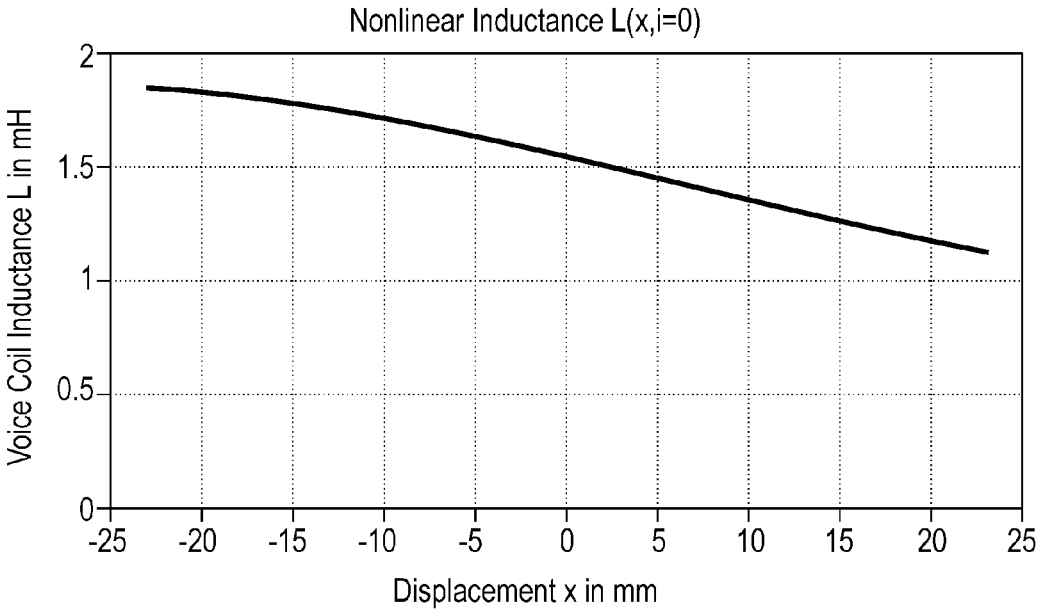
FIG. 2 (PRIOR ART)
FIG. 2 is a graph of the dependence of the voice coil inductance on the position of the voice coil.
Figure 3:
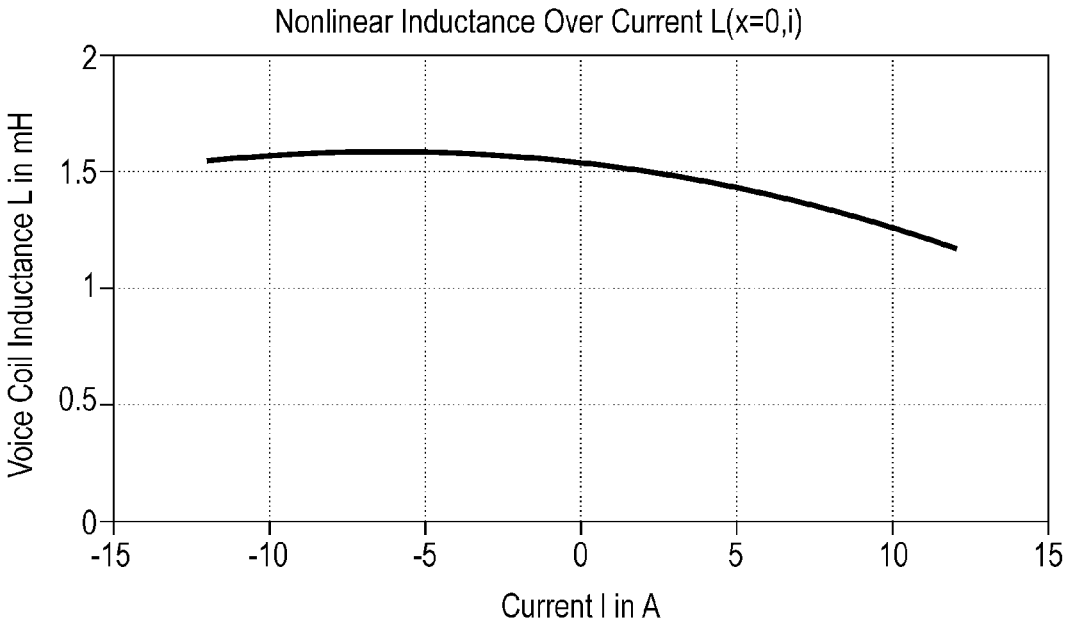
FIG. 3 (PRIOR ART)
FIG. 3 is a graph of the dependence of the voice coil inductance on the voice coil current.
Figure 4:
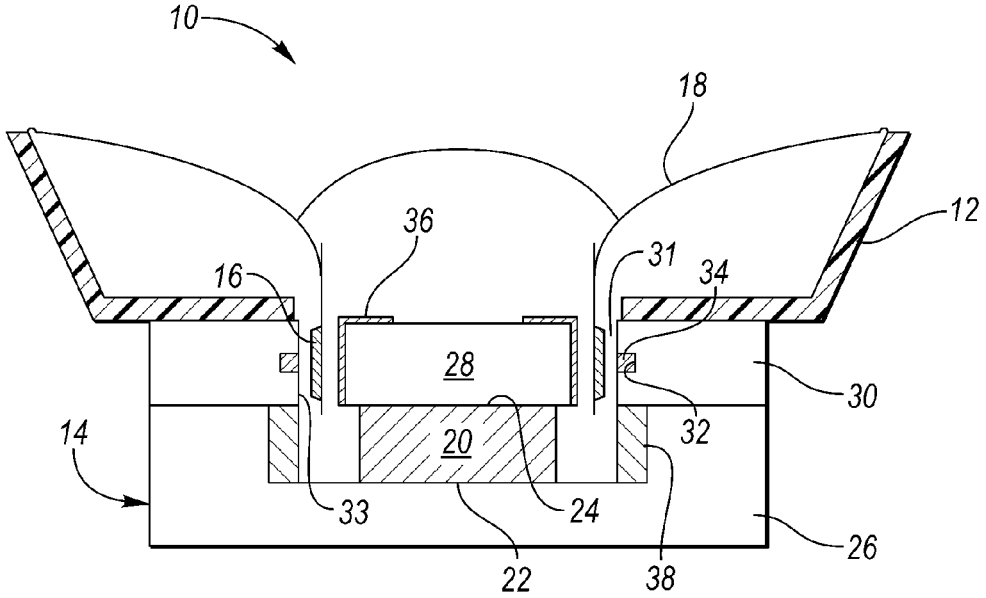
FIG. 4 is a cross-sectional view of a loudspeaker embodiment having an internal magnet and conducting elements.

FIG. 4 is a cross-sectional view of a loudspeaker 10 having an internal magnet and a plurality of conducting elements. Loudspeaker 10 generally comprises a frame 12, a motor assembly 14, a voice coil and former 16, and a cone (or diaphragm) and dust cap 18. The loudspeaker 10 may also include other components, such as a spider (not shown), as is known in the art.

The motor assembly 14 includes a permanent magnet 20, such as a neodymium internal magnet, where the magnet 20 has a first face 22 and a second face 24. The motor assembly 14 further includes a back plate 26 abutting the magnet first face 22, and a pole piece 28 centrally disposed with respect to the back plate 26, abutting the magnet second face 24 and extending beyond the magnet second face 24. A top plate 30 is concentrically disposed with respect to the pole piece 28, abutting the back plate 26 and extending beyond the magnet second face 24. The back plate 26 could also be defined as a shellpot structure with a pot wall attached to the back plate and a magnet received in the shellpot. A magnetic gap 31 is formed between the pole piece 28 and top plate 30 within which the voice coil 16 is axially movable.

With continuing reference to FIG. 4, the frame 12 is constructed from a non-magnetic conducting material, wherein in one embodiment at least a portion of the frame 12 comprises aluminum, or may alternatively comprise copper. The lower part of the frame 12 adjacent to the voice coil 16 behaves similar to a shorting ring, and the frame 12 provides linearization and symmetry of the alternating flux and, correspondingly, the voice coil's inductance.

Figure 6:
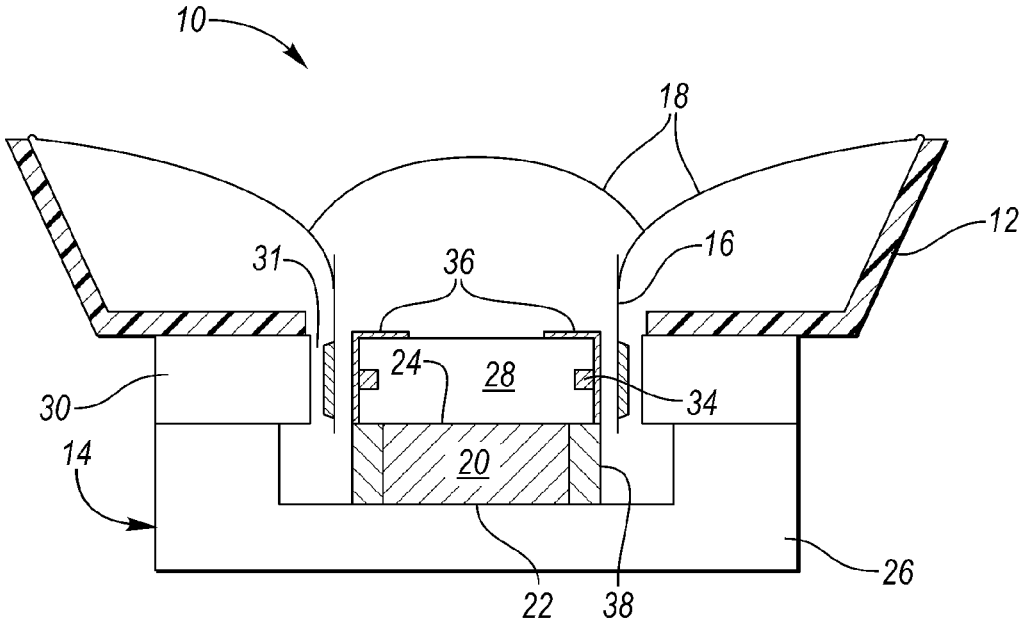
FIG. 6 is a cross-sectional view of a loudspeaker embodiment having an internal magnet and conducting elements, illustrating an alternative position of a copper ring.

The top plate 30 may include a groove 32 formed along an inner surface 33 thereof which linearizes the force factor Bl(x) and can receive a first non-magnetic conducting ring 34. In one embodiment, the first ring 34 comprises copper. Any dimensions and geometry of the first ring 34 appropriate for a particular loudspeaker may be utilized. FIG. 6 illustrates an alternative position of the first ring 34 disposed within the pole piece 28. In both the embodiments of FIG. 4 and FIG. 6, the first ring 34 is disposed within the motor assembly 14 so as to encircle the pole piece 28.

Figure 7:
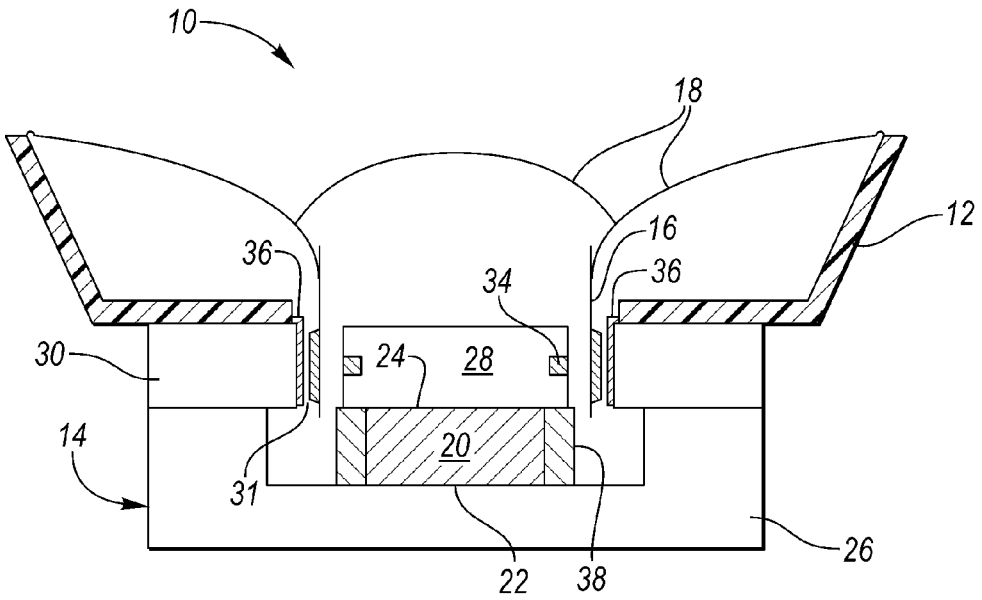
FIG. 7 is a cross-sectional view of a loudspeaker embodiment having an internal magnet and conducting elements, illustrating an alternative position of a copper cap.

In addition, the loudspeaker 10 may include a non-magnetic conducting cap 36 disposed within the motor assembly 14 and encircling the pole piece 28. In one embodiment, the cap 36 comprises copper. The cap 36 may abut two adjacent surfaces within the motor assembly 14 and may have a thickness of approximately 0.01 inches. However, any dimensions and geometry of the cap 36 appropriate for a particular loudspeaker may be utilized. In the embodiment of FIG. 4, the cap 36 abuts a portion of the pole piece 28, covering the surface of the pole piece 28 adjacent to the voice coil gap 31. In the embodiment of FIG. 7, the cap 36 instead abuts a portion of the top plate 30.

Figure 5:
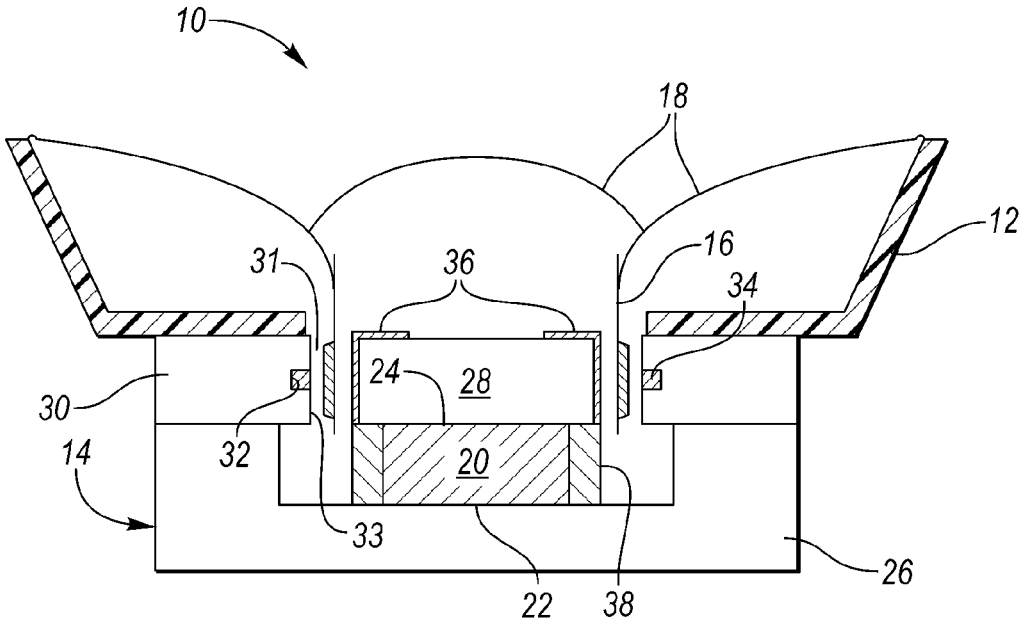
FIG. 5 is a cross-sectional view of a loudspeaker embodiment having an internal magnet and conducting elements, illustrating an alternative position of an aluminum ring.

Referring again to FIG. 4, at least one second non-magnetic conducting ring 38 may be disposed within the motor assembly 14 abutting the back plate 26. In one embodiment, the second ring 38 may comprise aluminum and, as for the other conducting elements described above, can have any dimensions and geometry suitable for a particular loudspeaker implementation. In the configuration depicted in FIG. 4, the second ring 38 is positioned to be spaced from the magnet 20. FIG. 5 illustrates an alternative position of the second ring 38 abutting the magnet 20.

Figure 8:
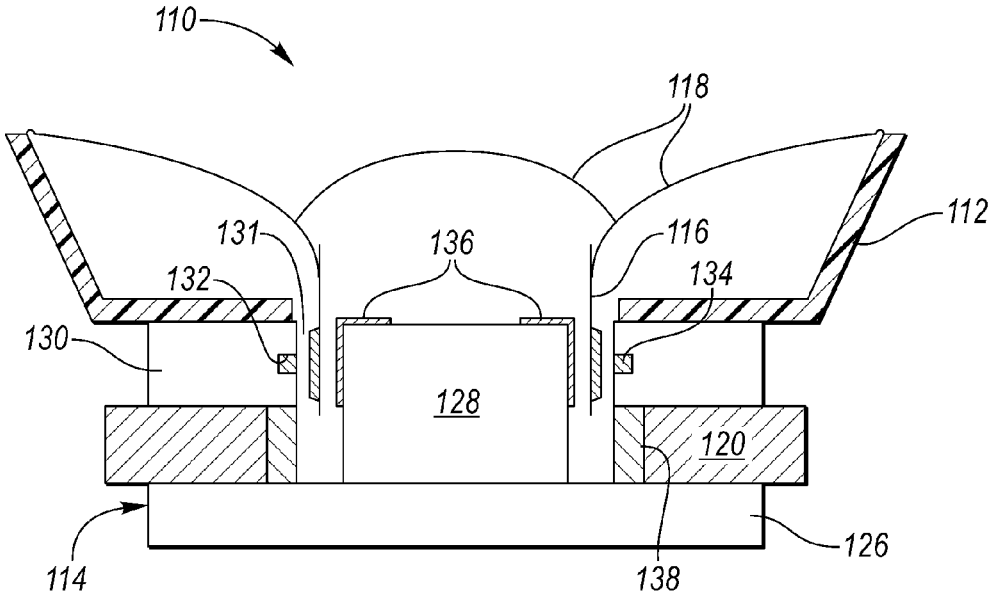
FIG. 8 is a cross-sectional view of a loudspeaker embodiment having an external magnet and conducting elements.

FIG. 8 is a cross-sectional view of a loudspeaker 110 having an external magnet and a plurality of conducting elements, wherein features of loudspeaker 110 similar to loudspeaker 10 are identified with like reference numerals with the addition of a "1" prefix. As above, loudspeaker 110 generally comprises a frame 112, a motor assembly 114, a voice coil and former 116, and a cone (or diaphragm) and dust cap 118. As above, the loudspeaker 110 may also include other components, such as a spider (not shown), as is known in the art.

The motor assembly 114 includes a permanent magnet 120, such as a ferrite, neodymium, or Alnico external magnet, where the magnet 120 has a first face 122 and a second face 124. The motor assembly 114 further includes a back plate 126 abutting the magnet first face 122, and a pole piece 128 centrally mounted with respect to the back plate 126 extending beyond the magnet second face 124. A top plate 130 is concentrically disposed with respect to the pole piece 128 and extending beyond the magnet second face 124. The magnet 120 is concentrically disposed about the pole piece 128 between the back plate 126 and the top plate 130. A magnetic gap is formed between the pole piece 128 and top plate 130 within which the voice coil 116 is axially movable.

Figure 9:
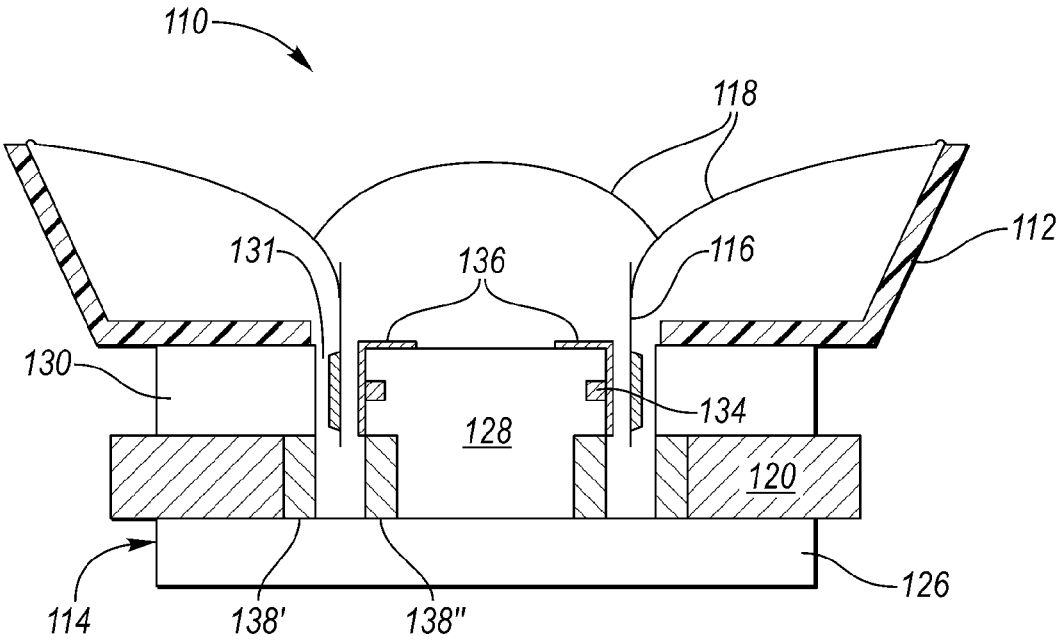
FIG. 9 is a cross-sectional view of a loudspeaker embodiment having an external magnet and conducting elements, illustrating concentric external and internal aluminum rings.
Figure 10:
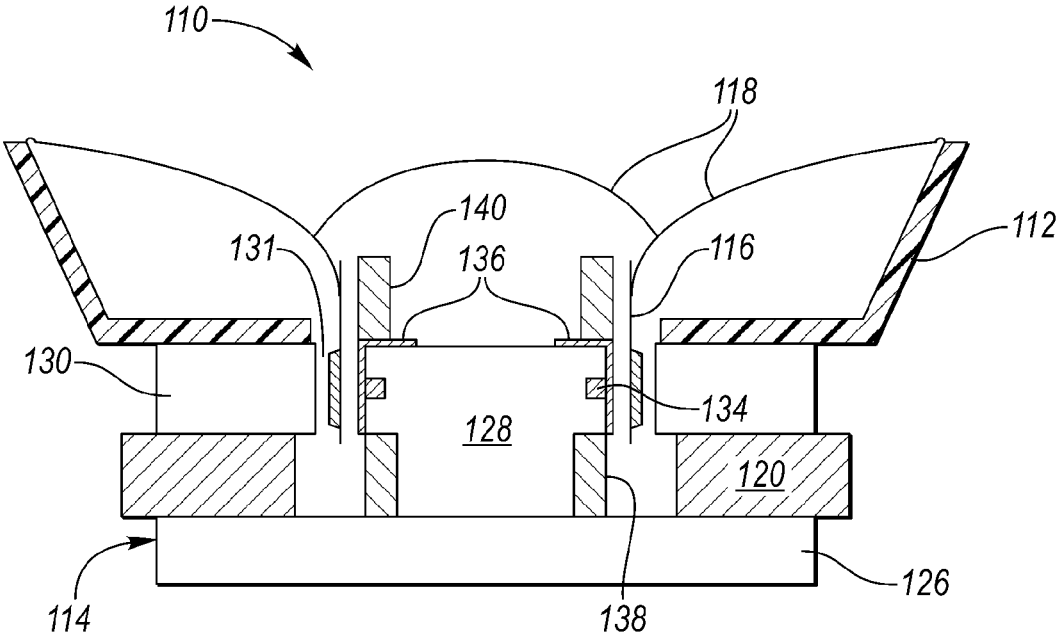
FIG. 10 is a cross-sectional view of a loudspeaker embodiment having an external magnet and conducting elements, including an additional aluminum ring.
Figure 11:
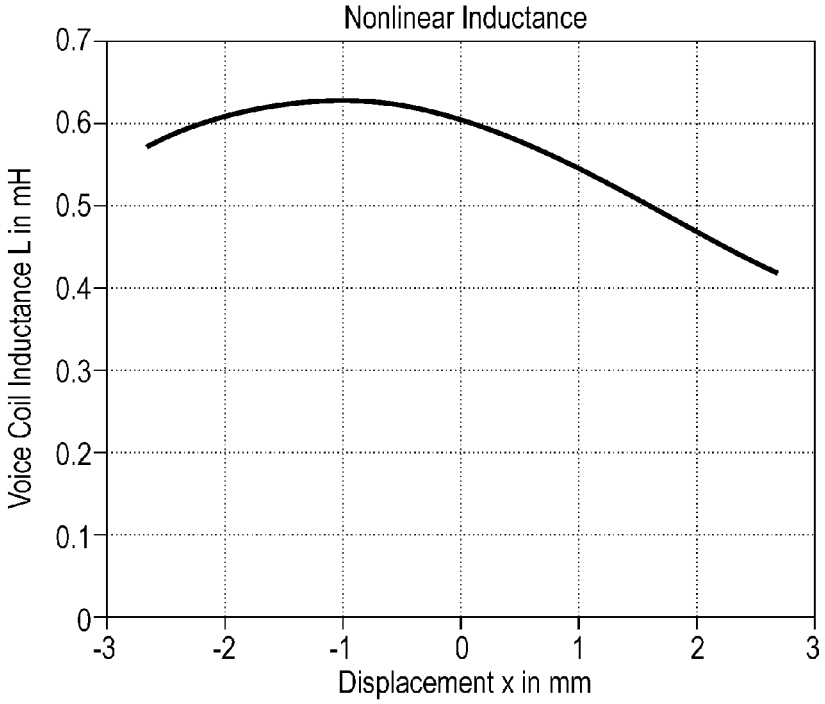
FIG. 11 is a graph of the measured voice coil inductance as a function of displacement for a loudspeaker embodiment with only an aluminum frame as a conducting element.
Figure 12:
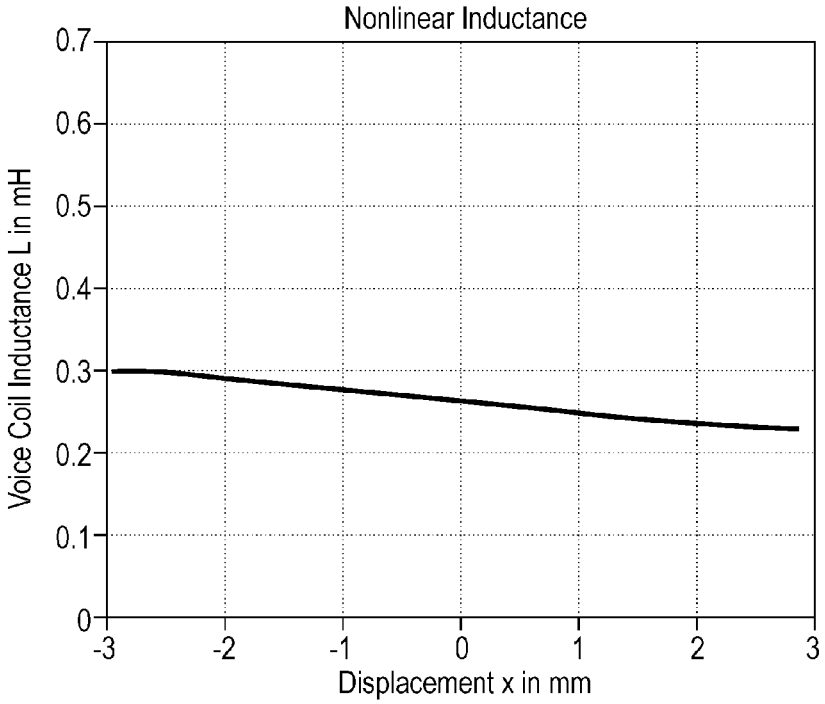
FIG. 12 is a graph of the measured voice coil inductance as a function of displacement for a loudspeaker embodiment with an aluminum frame and copper ring as conducting elements.
Figure 13:
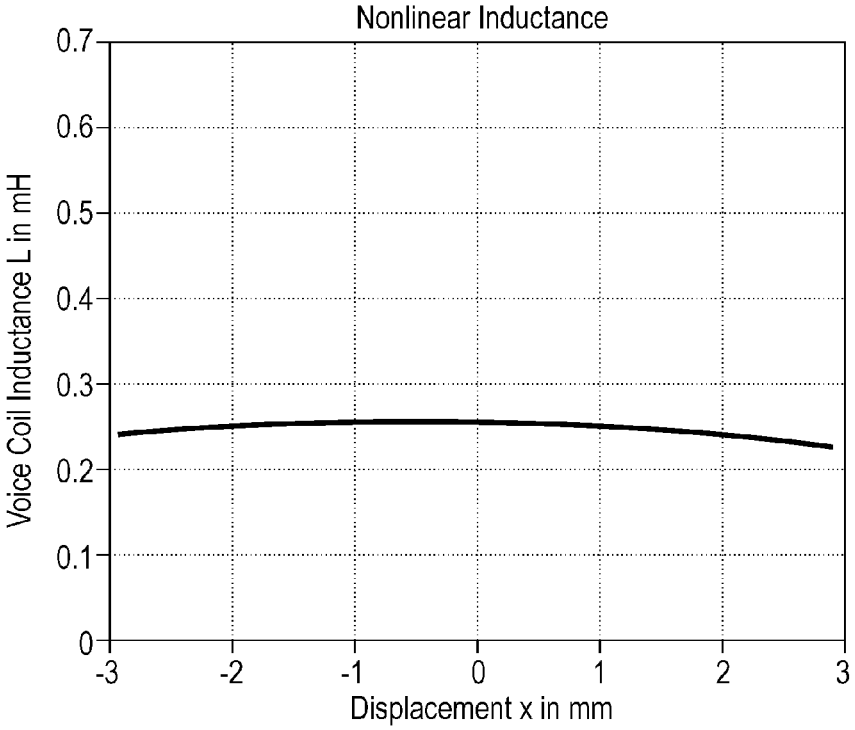
FIG. 13 is a graph of the measured voice coil inductance as a function of displacement for a loudspeaker embodiment with an aluminum frame, a copper ring, and an aluminum ring as conducting elements.

FIG. 8 illustrates a loudspeaker 110 having the conducting elements described above, namely the frame 112, first ring 134, cap 136 and second ring 138, where it is understood that any of the conducting elements can have alternate positioning as described with reference to loudspeaker 10. FIGS. 9 and 10 depict further alternatives for conducting elements with reference to loudspeaker 110, although these alternatives are equally applicable to the embodiment of loudspeaker 10.

With reference to FIG. 9, concentric and spaced external 138' and internal 138" second rings. In one embodiment, the internal second ring 138" abuts the magnet 120 and the external second ring 138' abuts the pole piece 128. FIG. 10 illustrates an embodiment of loudspeaker 110 which includes a third non-magnetic conducting ring 140, which may comprise aluminum, abutting a top surface 142 of the pole piece 128.

Again, it is understood that the loudspeaker embodiments are not limited to those depicted herein, and that the placement of conducting elements within any embodiment can be interchanged and combined to form other embodiments.

The overall result is the increased linearity of the force Bl(x)i driving the voice coil 16 and minimization of the constant magnetic flux modulation due to the small value and linearity of the voice coil inductance $L_{vc}(x, i)$. This provides minimization of the corresponding nonlinear voltage term: $dL_{vc}(x, i)/dxdi$ as well as the nonlinear force term responsible for the reluctance force: $0.5\cdot(dL_{vc}(x, i)/dx)\cdot i^2$ (see equations 1 and 2).

Each conducting element contributes to the decrease of inductance and resistive losses associated with alternating magnetic flux. The aluminum ring 38 may not decrease the resistive losses at rest position since the copper elements 34, 36 are dominant, but it improves the linearity and symmetry. The low zero-displacement level of the voice coil inductance $L_{vc}(x)$ is provided by alternating magnetic fluxes generated by the combination of the copper cap 36 and the copper ring 34. Symmetry of the inductance $L_{vc}(x)$ is provided by the balance between the alternating flux generated by the lower part of the frame 12 and the alternating flux generated by the aluminum ring 38.

Figure 14:
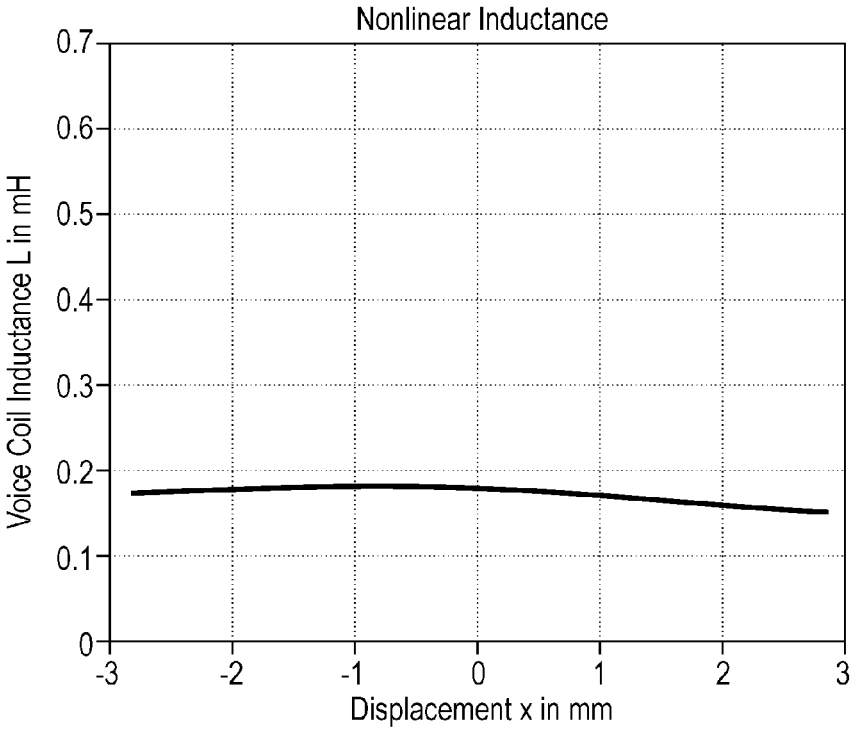
FIG. 14 is a graph of the measured voice coil inductance as a function of displacement for a loudspeaker embodiment with an aluminum frame, a copper ring, an aluminum ring and a copper cap as conducting elements.

FIGS. 11-14 are graphs of the measured voice coil inductance as a function of displacement for a loudspeaker embodiment with an aluminum frame as a conducting element (FIG. 11), a loudspeaker embodiment with an aluminum frame and copper ring as conducting elements (FIG. 12), a loudspeaker embodiment with an aluminum frame, a copper ring, and an aluminum ring as conducting elements (FIG. 13), and a loudspeaker embodiment with an aluminum frame, a copper ring, an aluminum ring and a copper cap as conducting elements (FIG. 14). Significant linearization of the voice coil inductance is observed with the addition of conducting elements.

Figure 15:
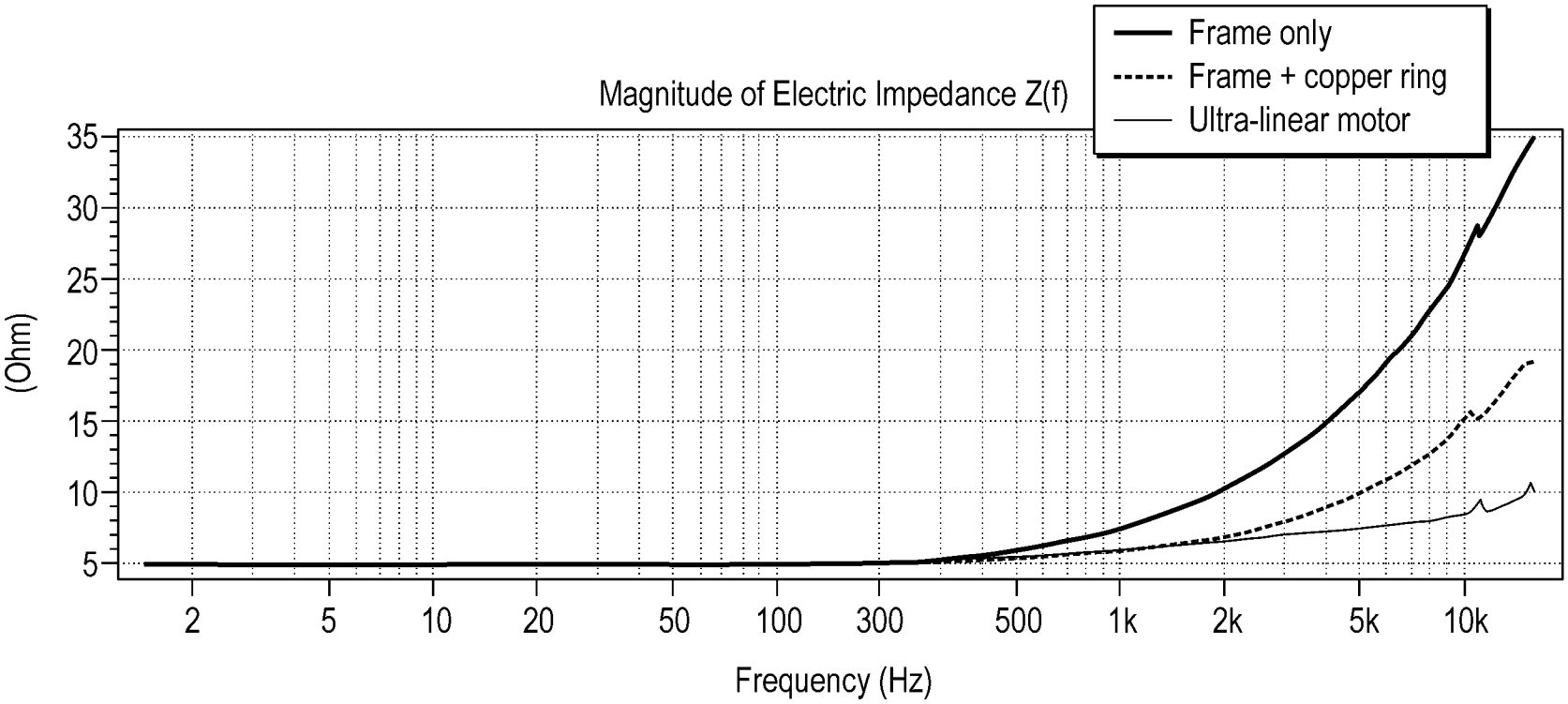
FIG. 15 is a graph depicting the decrease of the blocked voice coil impedance at high frequencies as a result of adding electrical current shorting elements to the motor, where the top curve is for a loudspeaker embodiment with only an aluminum frame as a conducting element, the middle curve is for a loudspeaker embodiment with an aluminum frame and copper ring as conducting elements, and the bottom curve is for a loudspeaker embodiment with an aluminum frame, a copper ring, a copper cap, and aluminum ring as conducting elements.

The reduced inductance also has significant influence on the electrical impedance of the voice coil, which is illustrated in the graph of FIG. 15 for different loudspeaker embodiments with the voice coil blocked in the center of the gap, where the top curve is for a loudspeaker embodiment with only an aluminum frame as a conducting element, the middle curve is for a loudspeaker embodiment with an aluminum frame and copper ring as conducting elements, and the bottom curve is for a loudspeaker embodiment with an aluminum frame, a copper ring, a copper cap, and aluminum ring as conducting elements. The lower absolute value of the impedance at higher frequencies helps to increase the high frequency output.

Finite element simulations allow for a detailed view of the magnetic losses of the inductance, and the dynamic simulation results can be decomposed to the frequency dependent inductance $L_{eff}(f,x)$ and resistive losses $R_{eff}(f,x)$.

Figure 16:
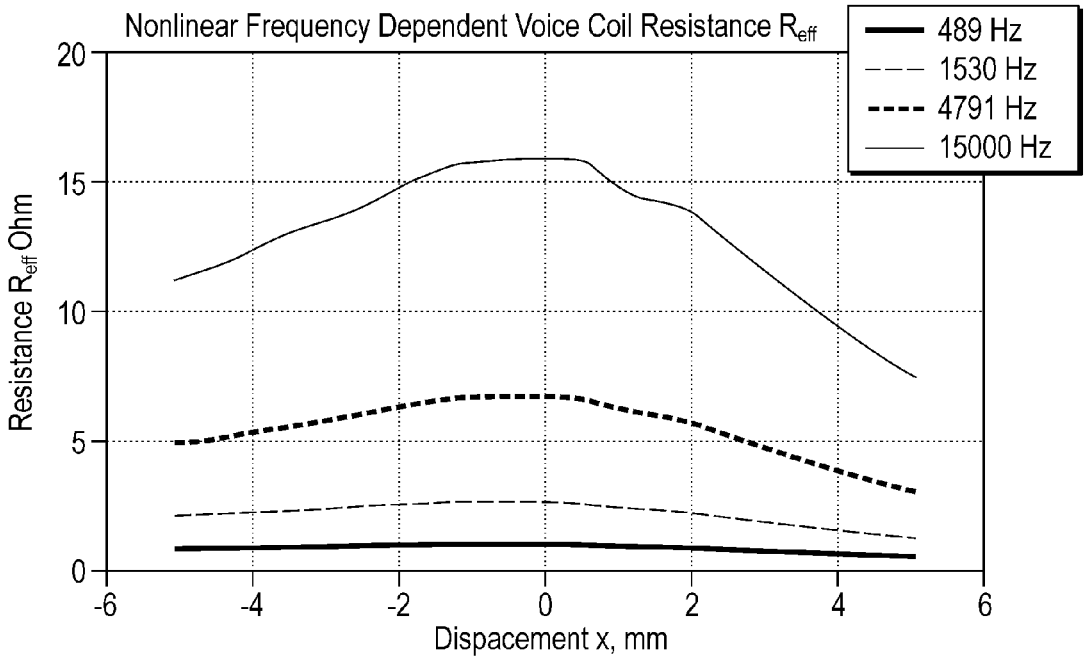
FIG. 16 is a graph of simulated frequency dependent voice coil resistance $R_{eff}$ as a function of displacement for a loudspeaker embodiment with only an aluminum frame as a conducting element.
Figure 17:
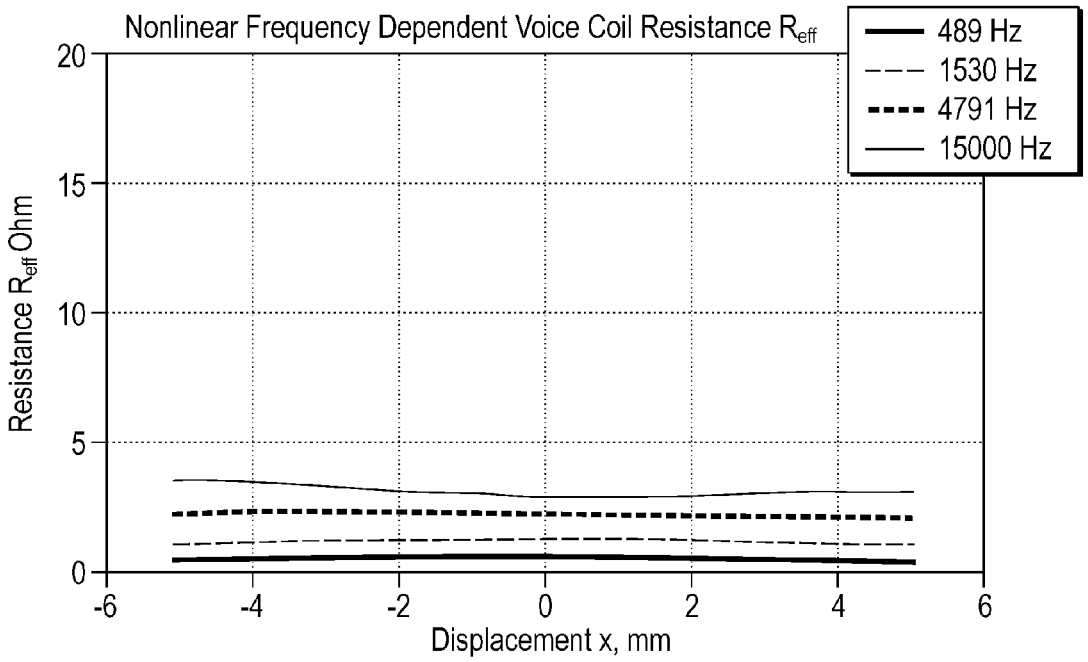
FIG. 17 is a graph of simulated frequency dependent voice coil resistance $R_{eff}$ as a function of displacement for a loudspeaker embodiment with an aluminum frame, a copper ring, a copper cap and an aluminum ring as conducting elements.

FIG. 16 is a graph of simulated frequency dependent voice coil resistance $R_{eff}$ as a function of displacement for a loudspeaker embodiment with an aluminum frame as a conducting element, and FIG. 17 is a graph of simulated frequency dependent voice coil resistance $R_{eff}$ as a function of displacement for a loudspeaker embodiment with an aluminum frame, copper ring, copper cap and aluminum rings as conducting elements. In FIG. 16, with an increase of frequency, at the zero-position the resistance increases and the dependence on the voice coil position increases as well. In FIG. 17, a lower dependence of the resistance on frequency can be observed, hence the overall level of the resistance is lower. This is indicative of the eddy currents running through more of the non-magnetic conducting materials (copper and aluminum). Thus, lower power is dissipated in the steel parts, and correspondingly, the temperature of the motor assembly at large levels of input signal will be lower as well and power handling increased. Besides the effect of the overall lower resistance, the four conducting element loudspeaker embodiment also shows a significant improvement of linearity.

Figure 18:
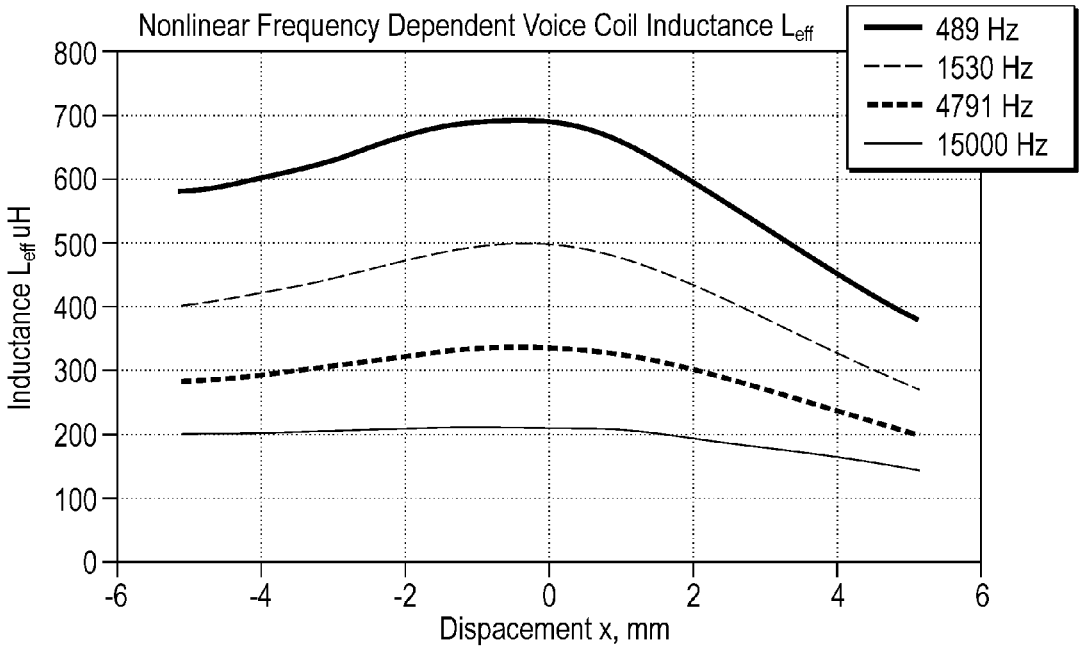
FIG. 18 is a graph of simulated frequency-dependent voice coil inductance $L_{eff}$ as a function of displacement for a loudspeaker embodiment with an aluminum frame as a conducting element.
Figure 19:
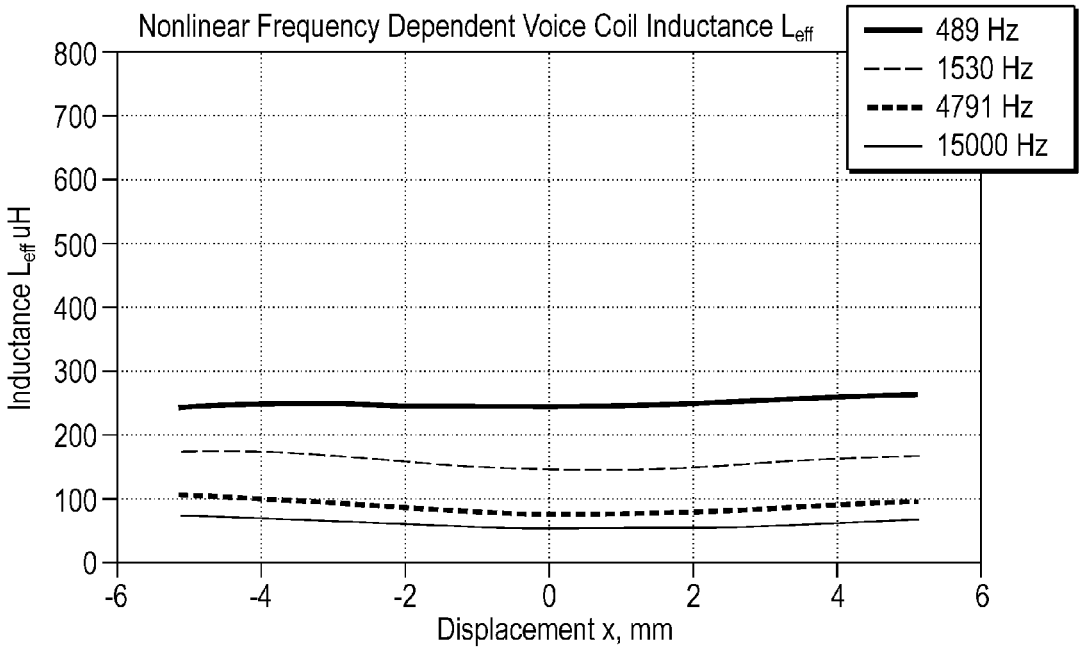
FIG. 19 is a graph of simulated frequency-dependent voice coil inductance $L_{eff}$ as a function of displacement for a loudspeaker embodiment with an aluminum frame, copper ring, copper cap and aluminum rings as conducting elements.

FIG. 18 is a graph of simulated frequency-dependent voice coil inductance $L_{eff}$ as a function of displacement for a loudspeaker embodiment with an aluminum frame as a conducting element, and FIG. 19 is a graph of simulated frequency-dependent voice coil inductance $L_{eff}$ as a function of displacement for a loudspeaker embodiment with an aluminum frame, copper ring, copper cap and aluminum rings as conducting elements. In FIG. 18, with an increase in frequency, the zero-position value of inductance decreases as well as the dependence of the inductance on displacement. FIG. 19 shows overall lower levels of the inductance compared with the embodiment of FIG. 18, and lower dependence of the inductance on frequency and the improvement of linearity are also observed.

As such, the electrodynamic loudspeaker described herein has a very low dependence of the voice coil inductance on displacement and current, while providing a very low "linear" level of the inductance. The embodiments may be used, but not limited to, in various generations of transducers for loudspeaker systems where a high level of performance is needed, for example, in touring, portable, studio monitors, installed sound professional loudspeakers, automotive and consumer loudspeakers.

A loudspeaker that is optimized with the plurality of conductive elements as described herein not only has a very linear inductance (e.g., as a function of the voice coil displacement and current), but it also has very low zero-displacement value of the inductance which significantly decreases the modulation of the permanent magnetic flux in the voice coil gap, and reduces the impedance increase towards higher frequencies. These effects help to reduce the distortion generated by the motor to a minimum even at high amplitudes of the input signal where displacement of the voice coil may be significant.

Conventional implementations such as a single copper cap, copper ring, or aluminum ring are targeted toward minimizing the voice coil dependence on the current and they decrease the absolute value of the inductance, but they do not necessarily decrease dependence of the voice coil inductance on the displacement. The embodiments as disclosed herein provide for a unique combination of individual current-conductive elements and their geometry and position in the motor are optimized by the dynamic finite element analysis.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A loudspeaker comprising:

a motor assembly including a magnet having a first face and a second face, a back plate abutting the magnet first face, a pole piece centrally disposed with respect to the back plate and extending beyond the magnet second face, and a top plate concentrically disposed with respect to the pole piece and extending beyond the magnet second face;

a non-magnetic conducting frame attached to the top plate;

a non-magnetic conducting cap disposed within the motor assembly and encircling the pole piece;

a first non-magnetic conducting ring disposed within the motor assembly and encircling the pole piece; and at least one second non-magnetic conducting ring disposed within the motor assembly and abutting the back plate.

2. The loudspeaker of claim 1, wherein the top plate includes a groove formed along an inner surface thereof, and the first ring is disposed in the groove.

3. The loudspeaker of claim 1, wherein the first ring is disposed in the pole piece.

4. The loudspeaker of claim 1, wherein the first ring comprises copper.

5. The loudspeaker of claim 1, wherein the cap abuts two adjacent surfaces within the motor assembly.

6. The loudspeaker of claim 1, wherein the cap abuts a portion of the pole piece.

7. The loudspeaker of claim 1, wherein the cap abuts a portion of the top plate.

8. The loudspeaker of claim 1, wherein the cap comprises copper.

9. The loudspeaker of claim 1, wherein the at least one second ring abuts the magnet.

10. The loudspeaker of claim 1, wherein the at least one second ring abuts the pole piece.

11. The loudspeaker of claim 1, wherein the at least one second ring includes an external second ring concentric with and spaced from an internal second ring.

12. The loudspeaker of claim 1, wherein at least one second ring comprises aluminum.

13. The loudspeaker of claim 1, further comprising a third non-magnetic conducting ring abutting a top surface of the pole piece.

14. The loudspeaker of claim 1, wherein the third ring comprises aluminum.

15. The loudspeaker of claim 1, wherein the frame comprises aluminum.

16. A loudspeaker comprising:

a motor assembly including a magnet having a first face and a second face, a back plate abutting the magnet first face, a pole piece abutting the magnet second face, and a top plate concentrically disposed with respect to the pole piece and abutting the back plate;

a frame attached to the top plate, at least a portion of the frame comprising aluminum;

a copper cap disposed within the motor assembly and encircling the pole piece;

a copper ring disposed within the motor assembly and encircling the pole piece; and at least one aluminum ring disposed within the motor assembly and abutting the back plate.

17. The loudspeaker of claim 16, wherein the top plate includes a groove formed along an inner surface thereof, and the copper ring is disposed in the groove.

18. The loudspeaker of claim 16, wherein the at least one aluminum ring includes an external aluminum ring concentric with and spaced from an internal aluminum ring.

19. A loudspeaker comprising:

a motor assembly including a back plate, a pole piece centrally mounted on the back plate, a top plate concentrically disposed about the pole piece, and a magnet concentrically disposed about the pole piece between the back plate and the top plate; and a frame attached to the top plate, at least a portion of the frame comprising aluminum;

a copper cap disposed within the motor assembly and encircling the pole piece;

a copper ring disposed within the motor assembly and encircling the pole piece; and at least one aluminum ring disposed within the motor assembly and abutting the back plate.

20. The loudspeaker of claim 19, wherein the top plate includes a groove formed along an inner surface thereof, and the copper ring is disposed in the groove.

* * * * *